US007732741B1

(12) United States Patent
Whitham

(10) Patent No.: US 7,732,741 B1
(45) Date of Patent: Jun. 8, 2010

(54) FOLDING ARTICULATING WING MECHANISM

(75) Inventor: Kent G. Whitham, Inyokern, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 938 days.

(21) Appl. No.: 11/518,734

(22) Filed: Aug. 31, 2006

(51) Int. Cl.
*F42B 13/32* (2006.01)

(52) U.S. Cl. ..... 244/3.27

(58) Field of Classification Search ..... 244/3.27–3.29, 244/3.24, 49
See application file for complete search history.

(56) References Cited

U.S. PATENT DOCUMENTS 3,125,956 A * 3/1964 Kongelbeck ..... 244/3.29
4,106,727 A 8/1978 Ortell
4,351,499 A 9/1982 Maudal
4,586,680 A 5/1986 DiTommaso
4,592,525 A 6/1986 Madderra
4,664,339 A * 5/1987 Crossfield ..... 244/3.28
4,667,899 A * 5/1987 Wedertz ..... 244/49
4,858,851 A 8/1989 Mancini
4,869,442 A * 9/1989 Miller ..... 244/3.28
5,240,203 A 8/1993 Myers
5,820,072 A * 10/1998 Na et al. ..... 244/49
6,260,797 B1 7/2001 Palmer
6,905,093 B2 * 6/2005 Dryer et al. ..... 244/3.28

* cited by examiner

*Primary Examiner*—Tien Dinh
(74) *Attorney, Agent, or Firm*—Christopher Blackburn; Brian F. Drazich

(57) ABSTRACT

A locking mechanism for securing an articulated folding wing assembly in a fully extended position by means of a tapered locking plunger urged by a coiled compression spring to contact a complementary mating surface formed on the wing assembly. The spring urged locking plunger is released from a retracted position by rotation of the wing assembly from the folded position to the extended position. A folding mechanism for rotating the wing assembly through a compound angle from the folded position to a rigid and positively locked fully extended position is provided wherein the extended wing may be rotated about its longitudinal axis to provide directional control to the vehicle.

3 Claims, 10 Drawing Sheets

FIG. 18
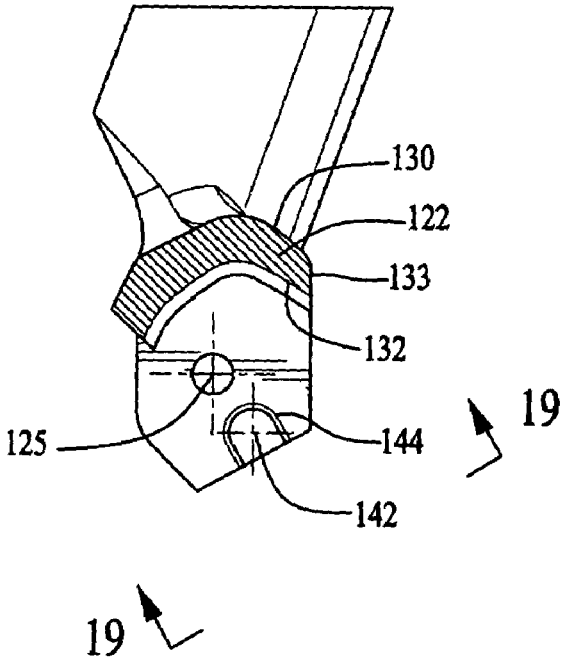
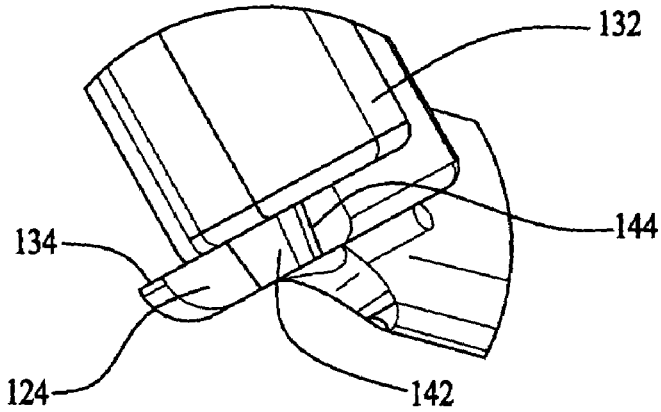
FIG. 19

FOLDING ARTICULATING WING MECHANISM

FIELD OF INVENTION

The present invention is directed to a mechanism to provide a compact foldable articulated wing assembly that positively locks in the fully extended position. The invention is useful for smaller unmanned aircraft such as tube launched missiles, shoulder launched missiles, surveillance drones, and the like where operational and/or storage volume requirements render fixed wing vehicles impracticable or undesirable, as well as other vehicles such as rotor craft and other types of aircraft where a folding rotor or wing may be desirable. The present invention provides a previously unavailable compact and reliable mechanism having a locking plunger and follower spring to provide a driven locking mechanism for the folding articulated wing assembly.

Conventional assemblies of the kind commonly used in the above described applications have exhibited a number of problems and drawbacks which the present invention is intended to improve upon. These problems and drawbacks include the use of many parts and often complicated combinations of motions between the parts to provide folded and extended wing positions, thereby tending to decrease reliability and to increase the complexity and cost of the manufacturing process.

SUMMARY OF INVENTION

Assemblies or mechanisms of the type commonly used in the above described applications and the like are well known. Examples of such folding mechanisms include those described in U.S. Pat. Nos. 6,260,797; 5,240,203; 4,858,851; 4,592,525; 4,586,680; 4,351,499 and 4,106,727.

A general description of the locking and folding mechanism or assembly of the present invention follows.

A locking mechanism for securing an articulated folding wing assembly in a fully extended position by means of a tapered locking plunger urged by a coiled compression spring to contact a complementary mating surface formed on the wing assembly is provided. The spring urged locking plunger is released from a retracted position by rotation of the wing assembly from the folded position to the extended position. A folding mechanism for rotating the wing assembly through a compound angle from the folded position to a rigid and positively locked fully extended position is provided wherein the extended wing may be rotated about its longitudinal axis to provide directional control to the vehicle.

BRIEF DESCRIPTION OF THE DRAWINGS

FIG. 18 is a cross-sectional view of the wing subassembly of the FIG. 1 embodiment taken along the line 18-18 of FIG. 13.

FIG. 19 is a view of the wing subassembly of the FIG. 1 embodiment taken along the line 19-19 of FIG. 18.

DETAILED DESCRIPTION OF PREFERRED EMBODIMENTS

A Preferred Embodiment of the Folding and Locking Mechanism

Figure 1:
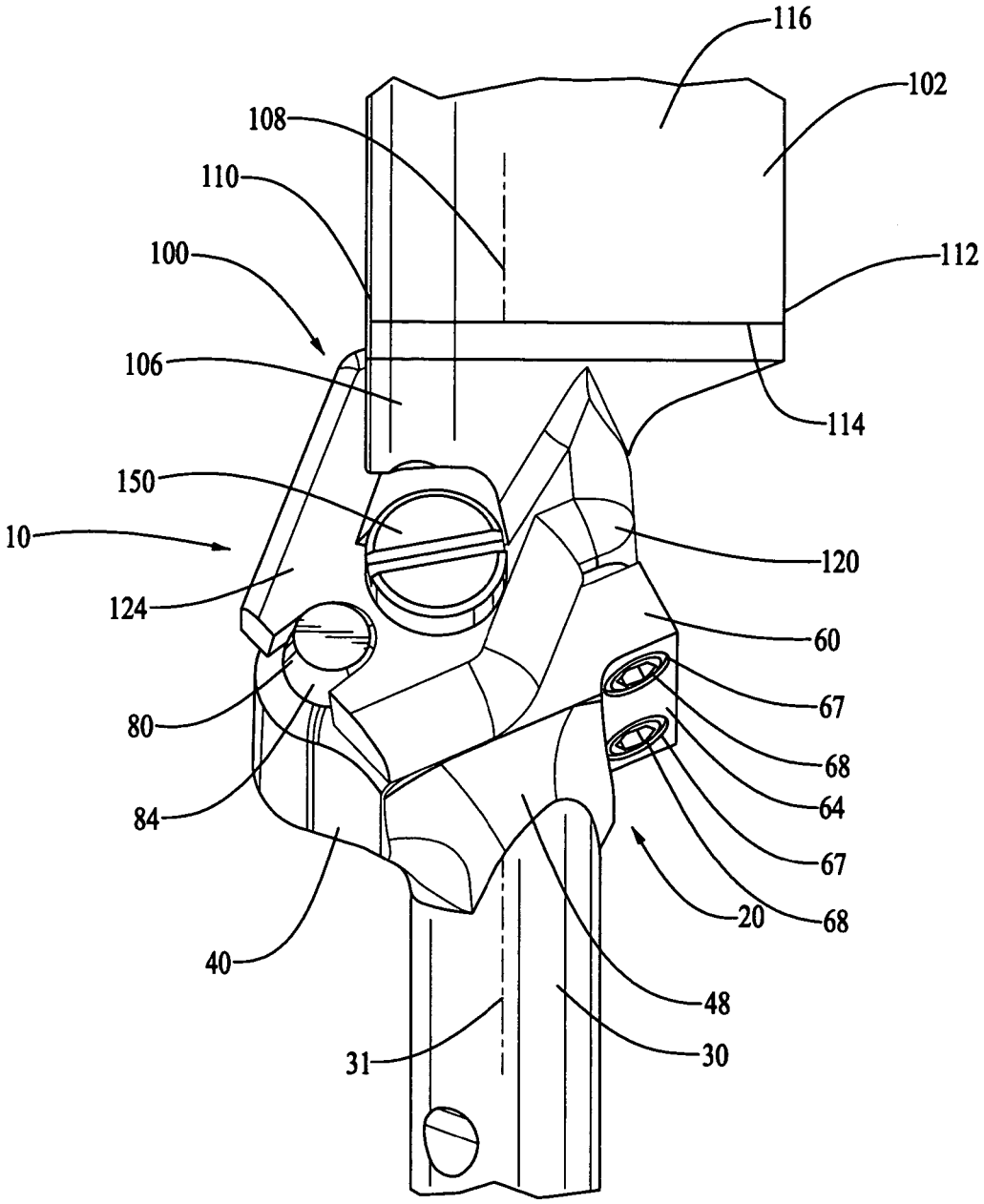
FIG. 1 is a top perspective view of a preferred embodiment of the folding mechanism in the extended and locked position.
Figure 2:
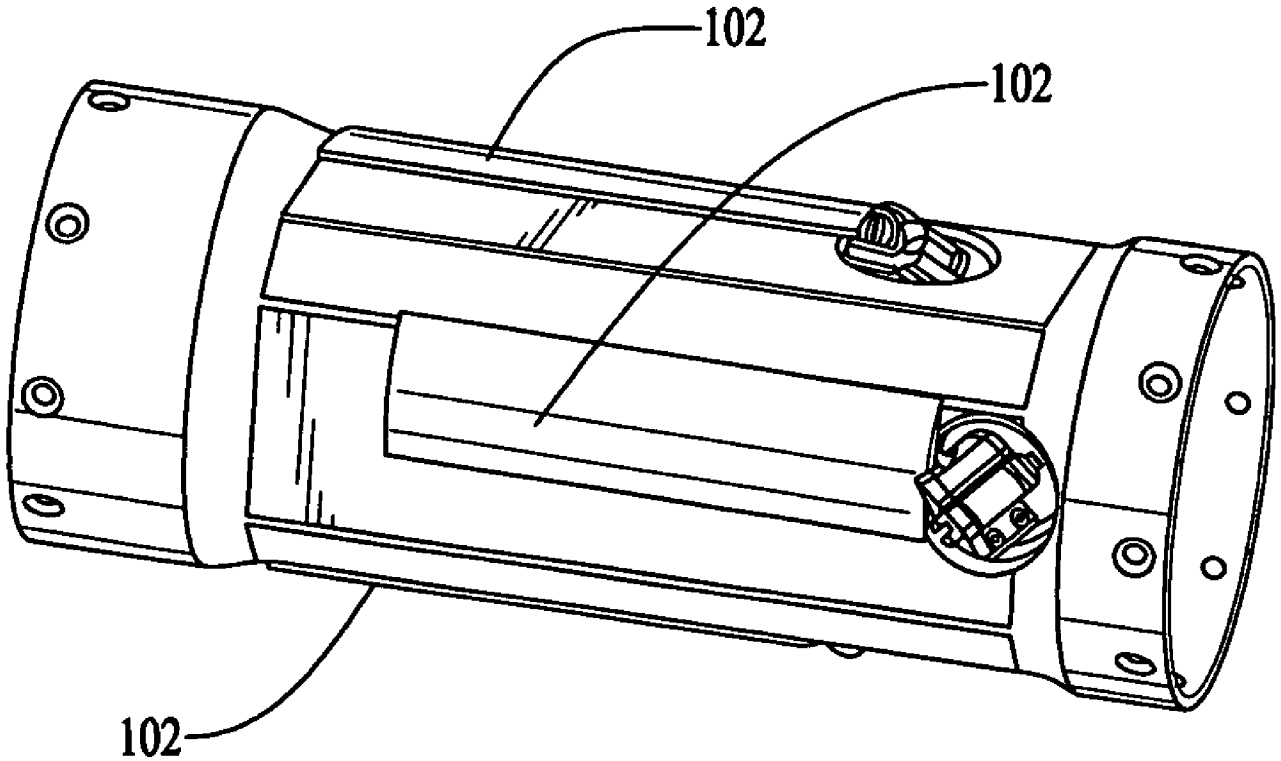
FIG. 2 is a side perspective view of the FIG. 1 embodiment of the folding mechanism in the folded position installed in a vehicle body.
Figure 3:
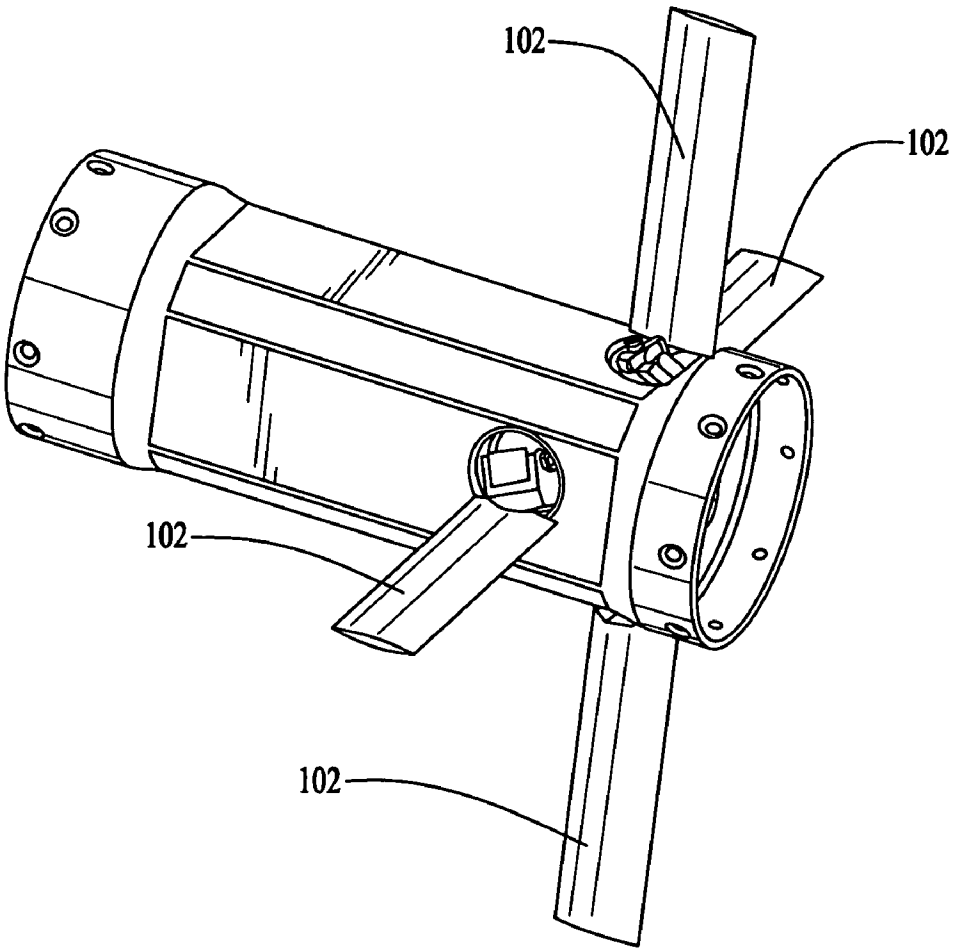
FIG. 3 is a side perspective view of the FIG. 1 embodiment of the folding mechanism in the extended and locked position installed in a vehicle body.
Figure 4:
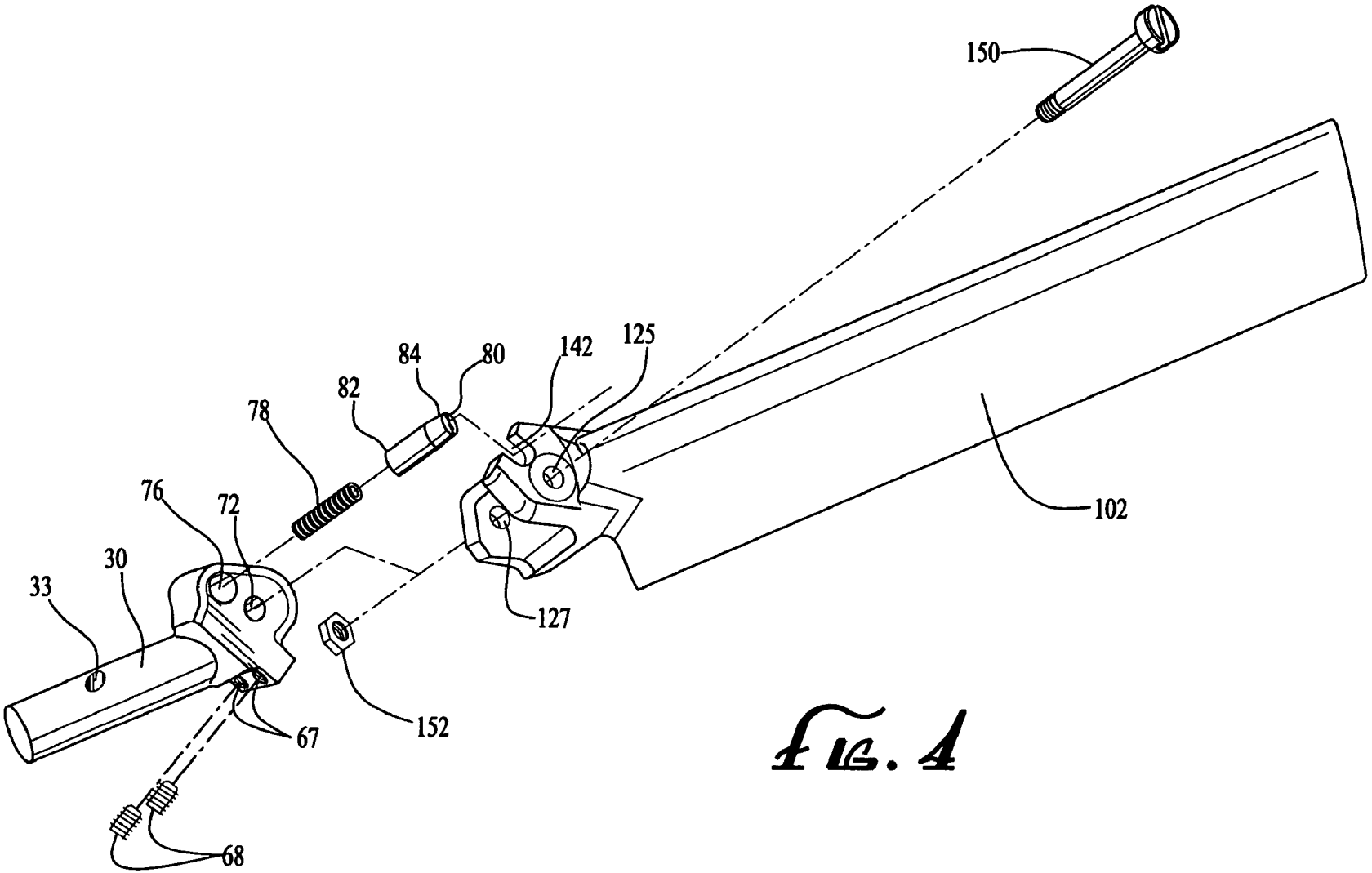
FIG. 4 is an exploded side perspective view of the FIG. 1 embodiment of the folding wing mechanism.
Figure 5:
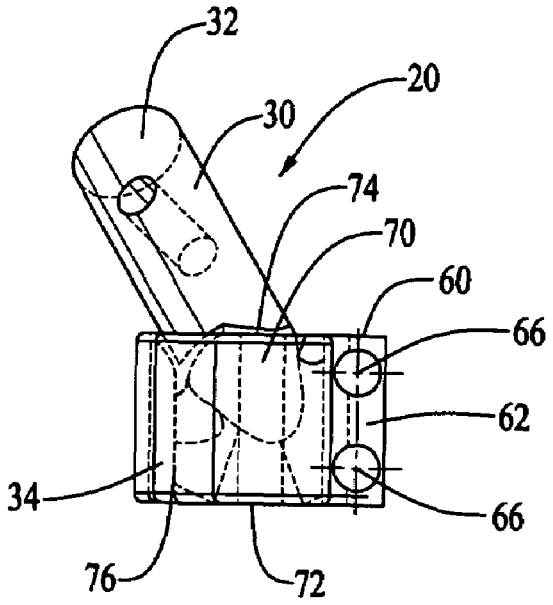
FIG. 5 is a top view of the shaft subassembly of the FIG. 1 embodiment.
Figure 6:
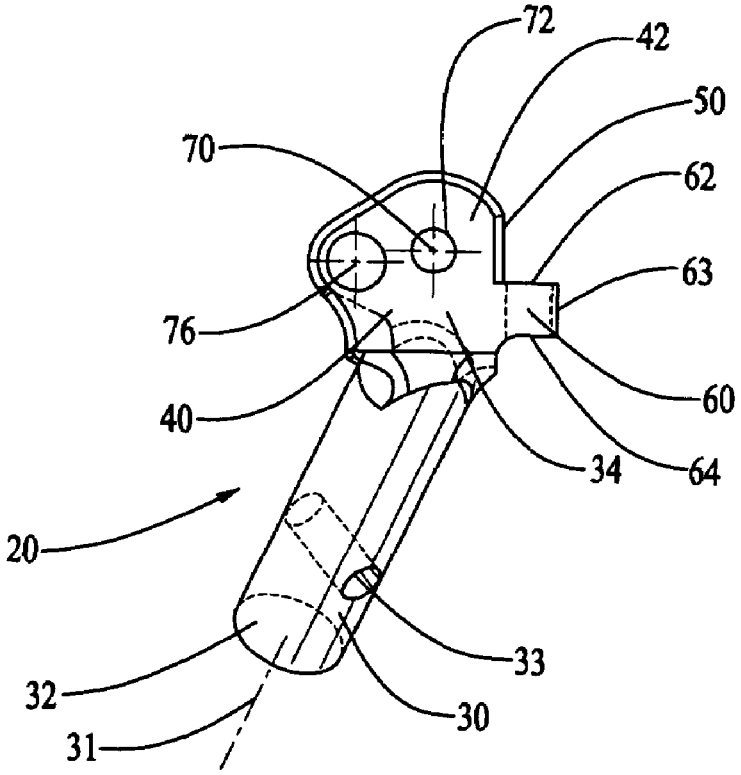
FIG. 6 is a side view of the shaft subassembly of the FIG. 1 embodiment.
Figure 7:
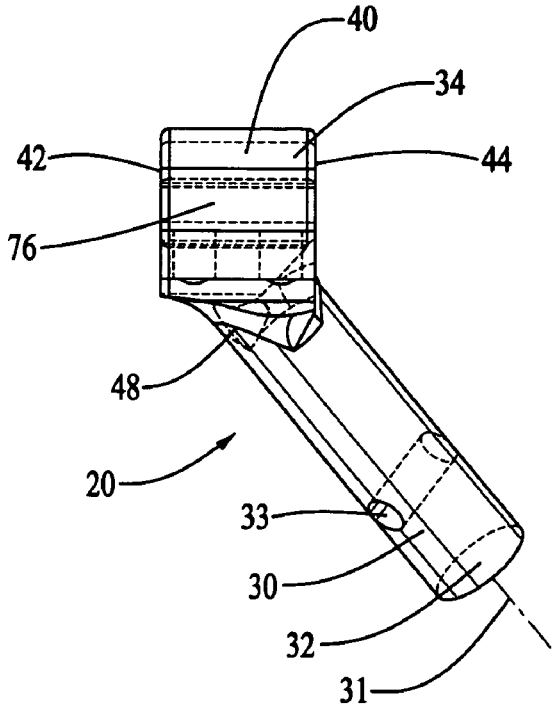
FIG. 7 is a bottom view of the shaft subassembly of the FIG. 1 embodiment.
Figure 8:
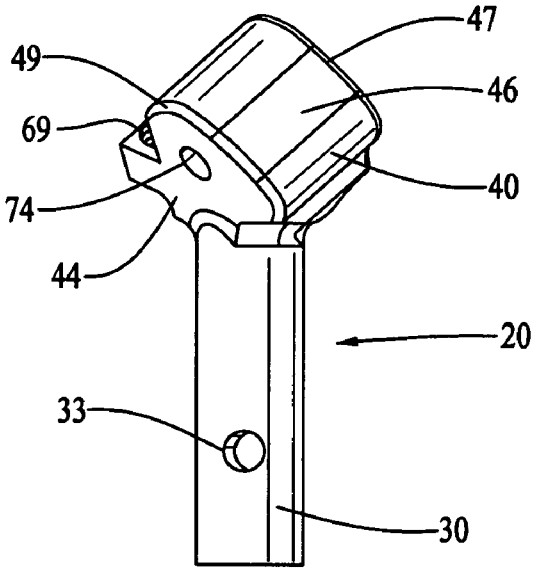
FIG. 8 is a front view of the shaft subassembly of the FIG. 1 embodiment.
Figure 9:
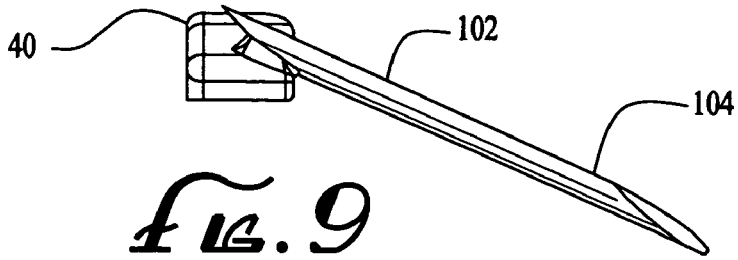
FIG. 9 is a top view of the wing subassembly of the FIG. 1 embodiment.
Figure 10:
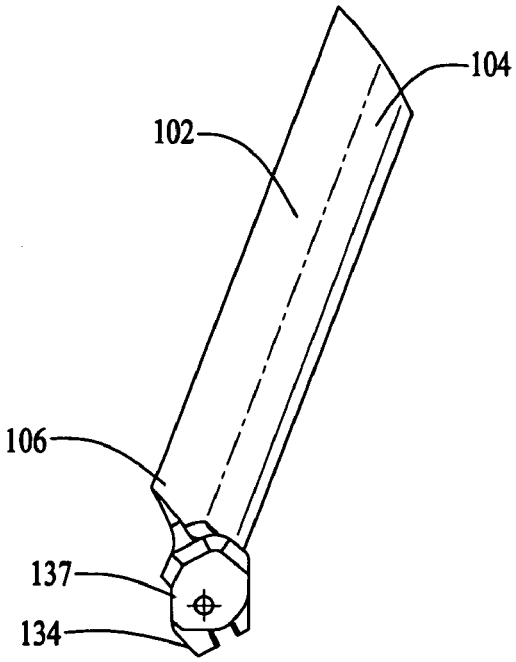
FIG. 10 is a side view of the wing subassembly of the FIG. 1 embodiment.
Figure 11:
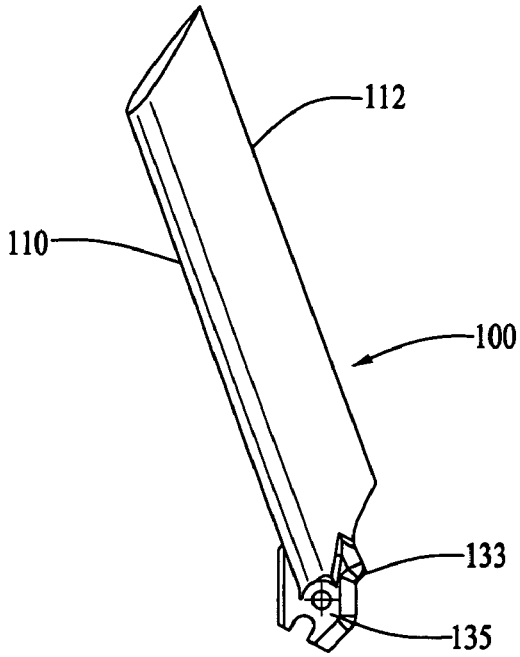
FIG. 11 is a side view of the opposite side of the wing subassembly of the FIG. 10 embodiment.
Figure 12:
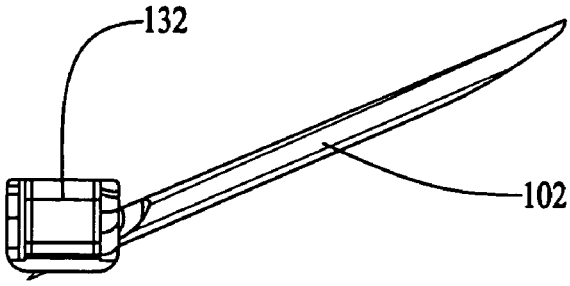
FIG. 12 is a bottom view of the wing subassembly of the FIG. 1 embodiment.
Figure 13:
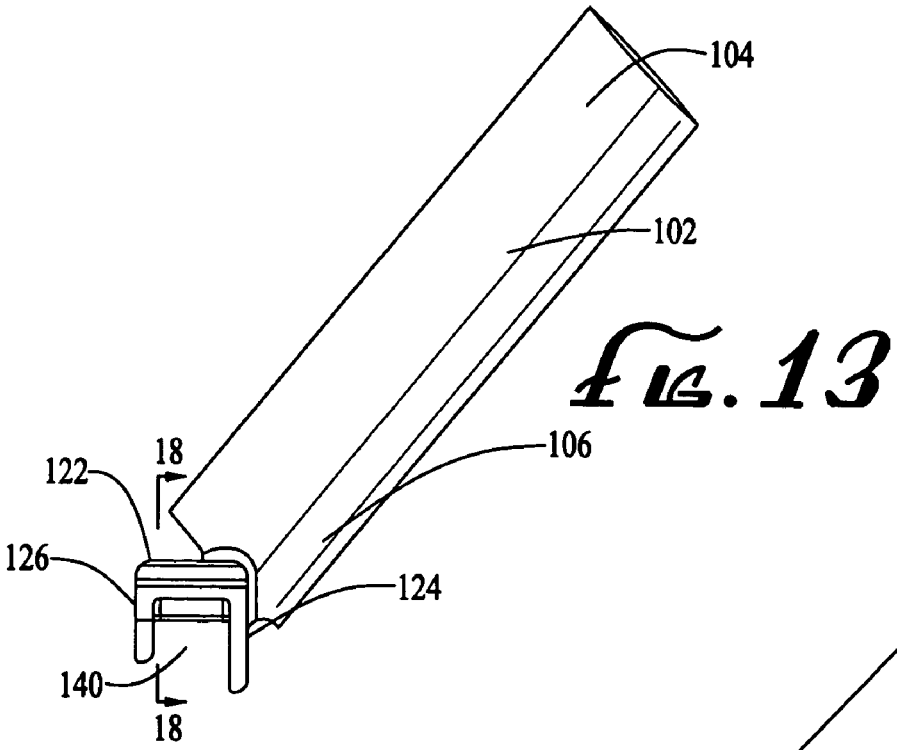
FIG. 13 is a front view of the wing subassembly of the FIG. 1 embodiment.
Figure 14:
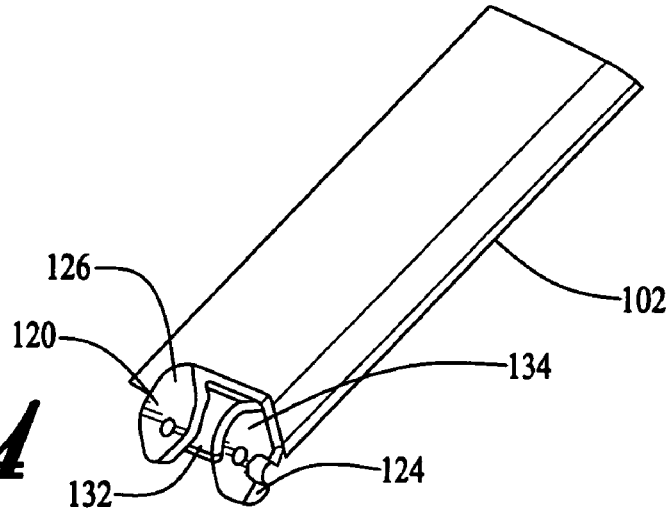
FIG. 14 is a bottom perspective view of the wing subassembly of the FIG. 1 embodiment.
Figure 15:
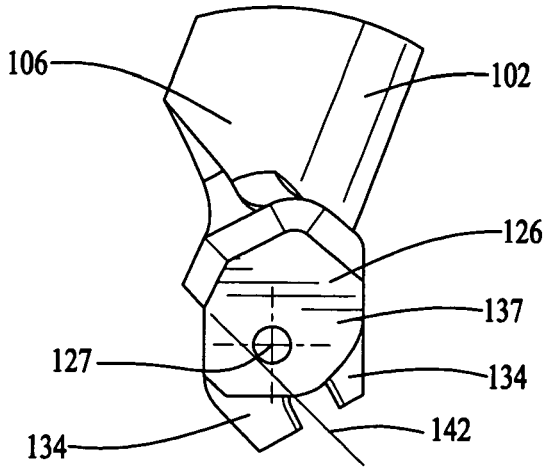
FIG. 15 is a detailed view of the wing subassembly of the FIG. 10 embodiment.
Figure 16:
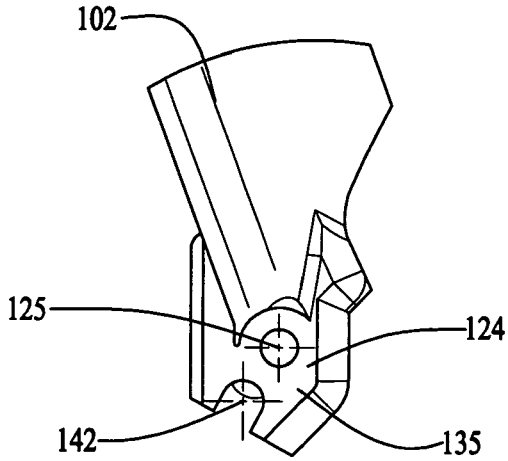
FIG. 16 is a detailed view of the wing subassembly of the FIG. 11 embodiment.
Figure 17:
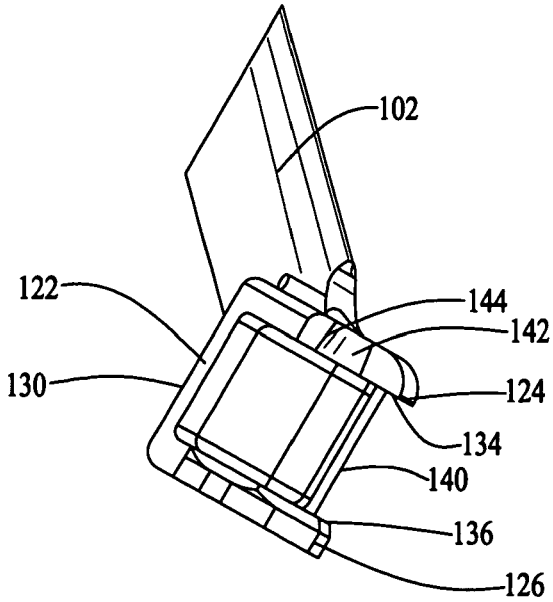
FIG. 17 is a side view the wing subassembly of the FIG. 11 embodiment.

With reference to FIGS. 1-19, a folding and locking mechanism (10) formed of an essentially rigid impact resistant and corrosion resistant material such as stainless steel, aluminum, a metal alloy, a composite material, or the like, having sufficient strength and rigidity to be used in this application. The mechanism (10) includes a rotatable shaft subassembly (20) and a rotatable wing subassembly (100). The shaft subassembly (20) includes a cylindrical shaft (30) having a first end portion (32) and a second end portion (34) at which a knuckle (40) is integrally formed. First end portion (32) of shaft (30) is adapted to operatively engage an actuator of the vehicle flight control system. Mounting hole (33) bored through shaft (30) and perpendicularly intersecting the longitudinal axis (31) of shaft (30) facilitates operatively connecting mechanism (10) with a vehicle flight control system. The wing subassembly (100) includes a wing (102) having a distal wingtip (104) and a proximal wingroot (106) at which wingroot a bracket (120) is integrally formed.

With reference to FIGS. 1-9, the knuckle (40) of shaft subassembly (20) defines a first flat planar side face (42) and a second flat planar side face (44). The plane containing first planar side face (42) is parallel to and spaced apart from the plane containing second planar side face (44). Extending between planar side faces (42) and (44) is knuckle curvilinear upper surface (46). Preferably, the edges (47), (49) of curvilinear upper surface (46) at its junction with planar side faces (42), (44), respectively, are rounded or beveled to facilitate ease of operation of mechanism (10). Also extending between planar side faces (42), (44) and adjoining upper surface (46) is knuckle front face (50) which preferably is planar. Projecting outwardly from knuckle front face (50) is knuckle platform (60). Preferably, platform (60) extends across the width of knuckle (40) defined by the distance between planar side faces (42), (44). Platform (60) includes platform top surface (62), platform bottom surface (64) and platform front face (63) which front face defines the thickness of platform (60). Preferably, platform top surface (62), platform bottom surface (64) and platform front face (63) are all flat planar surfaces. Preferably, the angle between knuckle front face (50) and platform top surface (62) is 90°. Preferably, penetrating entirely through platform (60) from platform top surface (62) to platform bottom surface (64) and opening onto platform top surface (62) and onto platform bottom surface (64) are one or more channels (66). The channels (66) are adapted to accept adjustable setting screws (68) inserted through the channel bottom opening (67) formed in platform bottom surface (64). The adjustable setting screws (68) may be adjusted to extend through the channel top opening (69) formed in platform top surface (62) so as to extend outwardly above top surface (62).

With yet further reference to FIGS. 1-9, the knuckle base (48) is bounded around its perimeter by first flat planar side face (42), knuckle curvilinear upper surface (46), second flat planar side face (44) and platform bottom surface (64). Integrally formed cylindrical shaft (30) and knuckle (40) are joined or merged at the junction of knuckle base (48) of knuckle (40) and second end portion (34) of cylindrical shaft (30). Axle bore (70) penetrates entirely through knuckle (40) perpendicularly from knuckle first flat planar side face (42) to knuckle second flat planar side face (44) forming first axle hole opening (72) on side face (42) and forming second axle hole opening (74) on side face (44). Cylindrical plunger cavity (76) penetrates partially, but preferably not entirely, through knuckle (40) perpendicularly from knuckle first flat planar side face (42) to a depth sufficient to contain coiled compression spring (78) and cylindrical locking plunger (80) when the coil spring (78) installed at the closed end of cavity (76) is compressed by plunger (80) installed and retained in cavity (76) atop spring (78). The longitudinal axis of plunger cavity (76) and the longitudinal axis of axle bore (70) preferably are parallel and spaced apart.

Now with reference to FIGS. 1-9, cylindrical locking plunger (80) includes a first plunger end (82) adapted to engage coil spring (78) and a second plunger end (84) adapted to matingly engage a complementary portion of the wing subassembly (100). The central longitudinal axis of plunger cavity (76) and the central longitudinal axis of locking plunger (80) are coincident. The second plunger end (84) of locking plunger (80) defines a truncated cone with the tapered portion of plunger end (84) having a taper angle preferably of about 8° relative to the longitudinal axis of plunger (80). Preferably, the planes containing a side face (42) or (44), the plane containing platform top surface (62), and the plane containing front face (50) are orthogonal. In a first embodiment, the angle between the plane containing platform top surface (62) and the longitudinal axis (31) of shaft (30) projected onto a plane parallel to a side face (42), (44) is preferably about 115.4°. Similarly, in the first embodiment, the angle between the plane containing platform top surface (62) and the longitudinal axis (31) of shaft (30) projected onto a plane parallel to front face (50) is preferably about 50.0°. Also, in the first embodiment, the angle between the plane containing a side face (42), (44) and the longitudinal axis (31) of shaft (30) projected onto a plane parallel to platform top surface (62) is preferably about 60.5°.

With reference to FIGS. 1-3 and 10-19, the wing subassembly (100) includes a wing (102) having a distal wingtip (104) and a proximal wingroot (106) at which wingroot a bracket (120) is integrally formed. Wing (102) defines a wing longitudinal axis (108) extending from wingroot (106) to wingtip (104) which longitudinal axis (108) is parallel and coincident with the central longitudinal axis (31) of shaft (30) when rotatable wing subassembly (100) and rotatable shaft subassembly (20) are aligned with the wing (102) in the fully extended position. Wing (102) includes leading edge (110) and trailing edge (112). The wing chord (114) extends from leading edge (110) to trailing edge (112) and is perpendicular to axis (108). The wing chord (114) and perpendicular longitudinal axis (108) define the wing plane (116).

Integrally formed with wingroot (106) is wing bracket (120) having curvilinear wall (122) and parallel side walls (124), (126). Curvilinear wall (122) extends between and joins parallel side walls (124), (126). Curvilinear wall (122) includes outer surface (130), inner surface (132) and preferably planar first edge surface (133) that extends between side walls (124), (126). First bracket side wall (124) includes planar inner face (134) and outer surface (135). Second bracket side wall (126) includes planar inner face (136) and outer surface (137). Inner face (134) of side wall (124) and inner face (136) of side wall (126) preferably are parallel. The inner surface (132) of curvilinear wall (122) and inner faces (134), (136) define bracket socket (140) adapted to rotatingly receive knuckle (40) of shaft subassembly (20). Bracket side walls (124), (126) each include an axle hole (125), (127), respectively, that completely penetrate side walls (124), (126) from the inner faces (134), (136) to the outer surfaces (135), (137). Axle holes (125), (127) are coaxially aligned. First bracket side wall (124) includes semi-cylindrical aperture (142) that extends completely through side wall (124) from inner face (134) to outer surface (135) to form aperture wall (144) and which aperture (142) preferably does not include a closed perimeter. Aperture wall (144) is inclined about 8° relative to a normal to the plane of side wall (124) and is adapted to receive and releasably retain the tapered portion of plunger end (84).

With reference to FIGS. 1-3 and 10-19, shaft subassembly (20) and a wing subassembly (100) are rotatably joined by axle or bolt (150) which extends through axle hole (125) in bracket side wall (124) and through axle bore (70) in knuckle (40) as well as through axle hole (127) in bracket side wall (126). Bolt or axle (150) is retained by a nut (152), or by threads in one of the axle holes (125), (127), or by any conventional means having the required strength and which allows subassembly (20) and subassembly (100) to freely rotate with respect to one another over the range of motion required to move from a fully folded wing position to a fully extended wing position.

The Folded Position of the Articulated Wing Mechanism

With reference to FIGS. 1-19, the mechanism (10) is in its fully retracted or folded position when knuckle curvilinear upper surface (46) is in touching contact with the inner surface (132) of bracket curvilinear wall (122) thereby stopping further rotation between shaft subassembly (20) and wing subassembly (100) to reduce the angle between the longitudinal axis (31) of shaft (30) and the longitudinal axis (108) of wing (102). In this folded position, a plane containing the longitudinal axis (108) of wing (102) may be drawn perpendicular to the longitudinal axis (31) of shaft (30). In the folded position the cylindrical locking plunger (80) and compressed coil spring (78) are confined within plunger cavity (76) of knuckle (40) by sliding contact between the planar inner face (134) of first bracket side wall (124) and the tapered end (84) of plunger (80) and plunger cavity (76) is not in coaxial alignment with aperture (142) in bracket side wall (124).

In the folded position, the mechanism (10) preferably is disposed with the axis (31) of shaft (30) perpendicular to the longitudinal axis of the vehicle in which the mechanism (10) is operationally installed and a plane containing the chord (114) of wing (102) is parallel to the longitudinal axis of the vehicle. Further, the mechanism (10) is oriented with the wingtip (104) toward the nose, or direction of travel of the vehicle, and the wingroot (106) is positioned aft of the wingtip (104).

The Extended and Locked Position of the Articulated Wing Mechanism

With reference to FIGS. 1-19, the mechanism (10) is in its fully extended and locked position when knuckle platform top surface (62), or the adjustable setting screws (68) extending above surface (62), is in touching contact with planar first edge surface (133) of bracket curvilinear wall (122) thereby stopping further rotation between shaft subassembly (20) and wing subassembly (100); and plunger cavity (76) is in coaxial alignment with aperture (142) in bracket side wall (124) permitting the tapered end (84) of plunger (80) driven by spring (78) to fully engage aperture (142) formed in bracket first side wall (124) thereby positively locking wing (102) in a fully extended position.

The Operation of the Articulated Wing Mechanism

With reference to FIGS. 1-19, the folding and locking articulated wing mechanism (10) preferably is operated by application of acceleration forces of vehicle launch and/or by resulting aerodynamic forces on the vehicle and wing mechanism (10) occurring during initial flight. During rapid acceleration directed along the longitudinal axis of the vehicle, inertial forces act on the folded wing subassembly (100) which cause the wing subassembly (100) to rotate about axle (150) with respect to constrained shaft subassembly (20) until the rotation is arrested by contact between knuckle platform top surface (62), or the adjustable setting screws (68) extending above surface (62), and planar first edge surface (133) of bracket curvilinear wall (122). In close temporal proximity with the foregoing, coaxial alignment is achieved between aperture (142) in bracket side wall (124) and knuckle plunger cavity (76) which allows compression spring (78) to drive the tapered end (84) of plunger (80) into locking engagement with complementary aperture (142) formed in bracket first side wall (124) thereby positively locking wing (102) in a fully extended position. Alternatively, the wing may be moved between the folded position and the fully extended and locked position manually or by any conventional device adapted to do so.

In the fully extended position, the longitudinal axis (108) of wing (102) and the longitudinal axis (31) of shaft (30) are in coincident alignment. This alignment of longitudinal axes permits vehicle flight control system actuators connected with shaft (30) to rotate the wing (102) about its longitudinal axis (108) to provide the vehicle directional flight control authority.

While the present invention has been described in connection with what are presently considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A folding wing mechanism comprising:

a shaft subassembly including a shaft portion and a knuckle portion;

a wing subassembly including a wing portion and a bracket portion;

the knuckle portion adapted to be matingly received by the bracket portion;

the bracket portion adapted to matingly receive the knuckle portion;

the knuckle portion received in the bracket portion and rotatingly connected thereto by an axle;

the shaft subassembly and the wing subassembly adapted for configuration in a first folded configuration by rotation about the axle;

the shaft subassembly and the wing subassembly adapted for configuration in a second extended configuration by rotation about the axle such that said wing portion experiences simultaneous rotation about the x and y axis of an external store's frame;

a spring urged locking plunger disposed in a cavity formed on said knuckle portion;

an aperture adapted to matingly receive the locking plunger formed on said bracket portion; and whereby the locking plunger is urged into mating contact with said aperture when the shaft subassembly and the wing subassembly are positioned in the second extended configuration.

2. The folding wing mechanism of claim 1 further comprising:

the locking plunger and the aperture are complementarily tapered at a predetermined angle with respect to the longitudinal axis of the locking plunger.

3. The folding wing mechanism of claim 1 wherein:

the locking plunger and the aperture are complementarily tapered at an angle of about 8° with respect to the longitudinal axis of the locking plunger.

* * * * *